United States Patent [19]

Nakakobara et al.

[11] 4,436,062

[45] Mar. 13, 1984

[54] ROCKER ARM MECHANISM IN OVERHEAD CAM TYPE ENGINE

[75] Inventors: Takeshi Nakakobara, Toyota; Kiyoshi Sakaguchi, Aichi; Fumio Ueda; Hiroyuki Murase, both of Toyota, all of Japan

[73] Assignee: Toyota Jidosha Kogyo Kabushiki Kaisha, Aichi, Japan

[21] Appl. No.: 319,902

[22] Filed: Nov. 10, 1981

[30] Foreign Application Priority Data

Nov. 14, 1980 [JP] Japan ..... 55-162806[U]

[51] Int. Cl.[3] ..... F01L 1/02

[52] U.S. Cl. ..... 123/90.27; 123/90.44

[58] Field of Search ..... 123/90.27, 90.39, 90.44, 123/90.49, 90.47

[56] References Cited

U.S. PATENT DOCUMENTS

| | | | |
|---|---|---|---|
| 1,172,362 | 2/1916 | Jackson | 123/90.44 |
| 1,270,941 | 7/1918 | Goodwin | 123/90.44 |
| 1,639,874 | 8/1927 | Woolson | 123/90.22 |
| 2,733,619 | 2/1956 | Smith | 123/90.48 |
| 3,855,981 | 12/1974 | Loon | 123/90.44 |

*Primary Examiner*—Craig R. Feinberg
*Assistant Examiner*—David A. Okonsky
*Attorney, Agent, or Firm*—Oblon, Fisher, Spivak, McClelland & Maier

[57] ABSTRACT

A rocker arm mechanism in an OHC type engine which includes a cam which is rotatable while interlocking with a crank shaft; and a rocker arm which oscillates in accordance with the rotation of the cam so as to open and close an intake valve and an exhaust valve, characterized in that the rocker arm includes a rocker arm body and a pad member rotatably fitted to the rocker arm body and adapted to be a contact portion to the cam, and that the cam and the pad member are brought into contact with each other such that the pad member may rotate due to a frictional force generated between the cam and the pad member as the cam rotates.

3 Claims, 5 Drawing Figures

ROCKER ARM MECHANISM IN OVERHEAD CAM TYPE ENGINE

BACKGROUND OF THE INVENTION

1. Field of the Invention

The present invention relates to the rocker arm mechanism in the overhead cam type engine (hereinafter referred to as "OHC" type engine) such that in the OHC type engine in which the cams are positioned over the cylinder head, the rotary driving motion of the cams is transformed into the reciprocating motion of the intake and exhaust valves via the rocker arms.

2. Description of the Prior Art

There have been conventionally available the following rocker arms:

(1) an integral type rocker arm, whole parts of which are made of the same material, (2) a composite type rocker arm in which the rock arm body and the pad member constituting the cam contact portion made of different material respectively are integrated by way of brazing, welding or the like, and (3) an encasting type rocker arm in which the above pad member is encast by aluminum or alluminum alloy.

However, all of these rocker arms are liable to suffer from scuffing and/or excessive wear at the portion of the rocker arms where they contact the cams, resulting in the generation of unnecessary noise and reduction in engine output.

As countermeasures against these unfavourable phenomena, recently the above composite type or encast type rocker arm with the pad member made of excellent wear-resistant material has come to be employed, but are not necessarily satisfactory. In particular, they are completely unsatisfactory when employed in the diesel engine.

SUMMARY OF THE INVENTION

Therefore, primary object of the present invention is to provide a rocker arm mechanism in an OHC type engine in which a pad member rotatably mounted onto a rocker arm body is brought into contact with a cam interlocking with a cam shaft in such a manner that the pad may rotate due to the frictional force produced between the cam and the pad member as the cam rotates and that the contact of the rocker arm to the cam may periodically move as the cam rotates, whereby an oil film is continuously formed at the point of contact between the rocker arm and the cam such that scuffing and the excessive wear do not easily take place.

Another object of the present invention is to provide a rocker arm mechanism in an OHC type engine in which the rotation of the pad member in accordance with the rotation of the cam is facilitated by the simplified construction such that in addition to the construction of the rocker arm mechanism in the primary object, the cam is brought into contact with the portion of the rocker arm at a place which deviates from the center of the rotation of the pad member.

Still another object of the present invention is to provide a rocker arm mechanism in an OHC type engine in which an almost half spherical pad member is integrally constituted by a shaft portion and a cam receiving portion integrally formed with one end of the shaft portion and the pad member is rotatably supported in a shaft hole bored in a rocker arm with its axis being orthogonal to the shaft of the cam, thereby simplifying the fitting structure of the pad member to the rocker arm.

A further object of the present invention is to provide a rocker arm mechanism in an OHC type engine in which a cam receiving portion integrally and concentrically formed with a shaft portion is rotatably fitted into a recess which is provided in a rocker arm body with its center being concentric with the center of the cam receiving portion, whereby an excessive force disrupting the rotation of the pad member can be prevented from being exerted between the rocker arm body and the pad member and the pad member can be rotatably supported onto the rocker arm body without backlash.

An even further object of the present invention is to provide a rocker arm mechanism in an OHC type engine in which a cam receiving portion comprises a spherical surface at the portion thereof facing with a cam and flat surface at its top portion and the cam is brought into contact with the cam at the flat surface of the cam receiving portion, whereby oil is can be easily and securely supplied onto the cam contacting portion of the cam receiving portion.

Another object of the present invention is to provide a rocker arm mechanism in an OHC type engine in which the cam face of the outer periphery of a cam is constituted by a curved surface parallel to a cam shaft and a tapered surface continuously provided with the curved surface and the joint between the curved surface and the tapered surface is brought into contact with a flat surface of the top portion of a cam receiving portion, whereby the cam is brought into point-contact with a pad member.

Other and further objects of this invention will become obvious upon an understanding of the illustrative embodiments described below or indicated in the appended claims, and various advantages not referred to herein will be understood by those skilled in the art upon employment of the invention in practice.

DETAILED DESCRIPTION OF THE PREFERRED EMBODIMENTS

The present invention will now be described in detail below based upon the preferred embodiments according to the present invention which are merely illustrative of the present invention but which are not in any manner intended to restrict the scope thereof.

Figure 1:
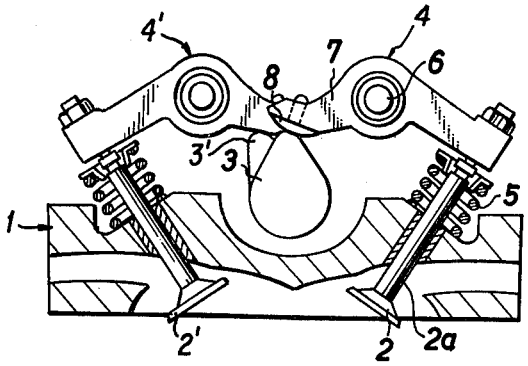
FIG. 1 is a sectional view illustrating an embodiment according to the present invention at the portion near an engine cylinder.

In FIG. 1, reference numerals 1, 2, 2', 3, 3', 4, 4' are an engine cylinder head, an intake valve, an exhaust valve, a cam for the intake valve, a cam for an exhaust valve, a rocker arm for the intake valve and a rocker arm for the exhaust valve, respectively. The explanation concerning the subject matter of this invention is provided hereinbelow regarding only the intake valve. The cam 3 and the rocker arm 4 constitute a rocker arm mechanism which is positioned over the cylinder head 1. The rocker arm 4 is in contact with a valve stem 2*a* of the suction valve at its one end, while the other end is in contact with the cam 3 by the restoring force of a spring 5. As the cam 3 rotates, the rocker arm 4 repeats an oscillating motion around the center of a rocker arm supporting shaft so that the intake valve 2 may have reciprocal movement (close and open).

Figure 2:
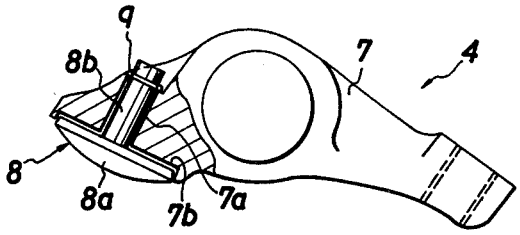
FIG. 2 is a sectional view of a part of the rocker arm mechanism shown in FIG. 1.
Figure 3:
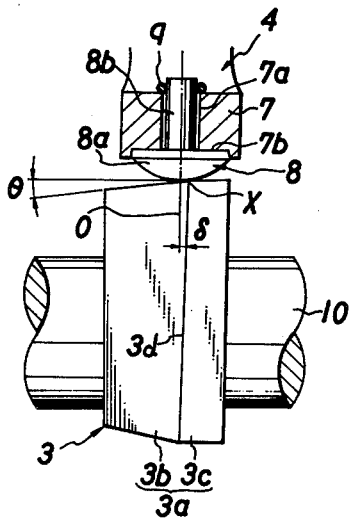
FIG. 3 is a partially sectional view of the rocker arm mechanism as viewed from the A-direction in FIG. 1.

As shown in FIGS. 2 and 3, the rocker arm is constituted by two parts, a rocker arm body 7 and a pad member 8. The pad member is a part which is adapted to contact the cam 3 and it is formed into an almost mushroom-shape with a material excellent in wear-resistance. The pad member has a cam receiving portion 8*a* like a dish and a shaft portion 8*b* which extends in a direction opposite to the cam from the middle portion of the cam receiving portion. In the cam facing end of the rocker arm 4 is bored a shaft hole 7*a* through which the shaft portion 8*b* is passed in the loose state. The shaft portion is prevented from slipping off from the shaft hole in the direction toward the cam by means of a hold loop 9 provided on one end of the shaft portion opposite to the pad member. The shaft hole 7*a* is designed orthogonal to the axis of a cam shaft 10 supporting the cam thereon.

The cam receiving portion 8*a* of the pad member comprises a spherical surface at its portion facing with the cam and a flat surface at its top portion orthogonal to the axis "O" of the shaft portion. The side circumference of the cam receiving portion at its side facing the rocker arm is loosely and rotatably fitted in the recess 7*b* concentrically formed with the shaft hole 7*a*. The recess is communicated with the shaft hole and the peripheral surface of the recess substantially constitutes a guide face for the rotation of the cam receiving portion. Both the bottom of the recess and the surface of the cam receiving portion 8*a* on the side facing the shaft portion 8*b* are designed to be flat intersecting orthogonally with the axis "O" of the shaft portion.

As shown in FIG. 3, the cam 3 has a cam face 3*a* which is constituted by a curved surface 3*c* parallel to the cam shaft 10 and a tapered surface 3*b* continuously provided with the curved surface 3*c*. The tapered surface 3*b* is tilted to the cam shaft by the angle of $\theta$. The joint 3*d* between the tapered surface and the curved surface is brought into point-contact with the flat surface of the cam receiving portion. The contact point "X" of the cam to the pad member is eccentric with the rotation center of the pad member, i.e. the axis "O" of the shaft portion by distance "$\delta$".

Next, the function of the rocker arm mechanism as constructed above will be explained below. As the cam 3 is rotated by driving the cam shaft, the rocker arm causes the oscillating motion to open and close the intake valve. A frictional force is generated at the contact "X" between the cam and the pad member due to the rotation of the cam. Since the contact point "X" deviates from the axis "O" by the distance "$\delta$", the pad member rotates around the axis "O" by receiving the above frictional force. The contact trace of the pad member to the cam is a circle of distance "$\delta$" in radius around the axis "O" and the contact of the pad member to the cam periodically moves. Therefore, an oil film is restored on the surface of the pad member which has been the contact X, that is, where the cam 3 has contacted by the time when the cam is brought into next contact with this surface and thus the cam 3 and the pad member 8 will be brought into contact with each other via a sufficient thickness of the oil film, thereby preventing scuffing and an excessive wear of the pad member. Even if a large frictional force is exerted on the pad member 8, the excessive wear can effectively be prevented because the large frictional force is offset by the rotation of the pad member 8.

Figure 4:
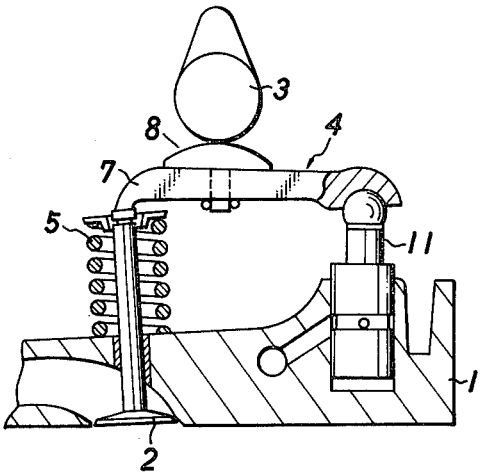
FIG. 4 is a sectional view of another rocker arm mechanism according to the present invention near an engine cylinder head.
Figure 5:
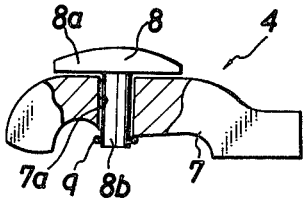
FIG. 5 is a partially sectional view of the rocker arm in FIG. 4.

FIGS. 4 and 5 illustrate another embodiment according to the present invention and illustration of parts similar to those in the first embodiment or the same parts as those in the latter are omitted by labelling these parts with the same reference numerals.

In this embodiment, the present invention is applied to a pivot type rocker arm mechanism and a rocker arm 4 oscillates around a lash adjuster 11 as an oscillation fulcrum. A pad member 8 is rotatably mounted onto the middle portion of a rocker arm body 7. The principal function itself is almost the same as in the first embodiment.

In the above, the specific embodiments according to the present invention are explained, but are merely illustrative of the present invention and it is believed obvious that modification and variation of the present invention are possible in light of the above teachings without departing from the spirit of essential characteristics thereof. For example, the cam 3 may be an offset cam instead of a tapered cam.

As mentioned above, the rocker arm mechanism according to the present invention has the merits of preventing or reducing scuffing and excessive wear, which result in reducing engine noise and improving engine output.

What is claimed as new and intended to be covered by United States Letters Patent is:

1. A rocker arm mechanism in an OHC type engine; an intake valve, an exhaust valve, and a cam shaft comprising:

a cam rotatable while interlocking with said cam shaft; and a rocker arm which oscillates in accordance with the rotation of said cam so as to open and close one of said intake valve and said exhaust valve, wherein said rocker arm further comprises a rocker arm body and a pad member rotatably fitted to said rocker arm body for contacting said cam, said cam and said pad member being brought into contact with each other such that said pad member may rotate due to a frictional force generated between said cam and said pad member as said cam rotates, wherein said contact of said pad member to said cam is eccentrically located with respect to a center of rotation of said pad member;

said pad member further comprises a shaft portion and a substantially half-spherical cam receiving portion integrally formed with one end of said shaft portion, said rocker arm body includes a shaft hole bored therein orthogonal to said cam shaft, and said shaft portion is rotatably supported in said shaft hole; and wherein said cam further comprises a curved surface parallel to said cam shaft, a tapered surface continuously formed with said curved surface and a joint formed between said curved surface and said tapered surface which contacts with said flat portion of said cam receiving member such that said cam and said pad member may be brought into point-contact with each other.

2. A rocker arm mechanism in an OHC engine as claimed in claim 1, wherein said cam receiving portion is concentric with said shaft portion and said shaft portion is rotatably fitted to a recess formed in said rocker arm body which is concentric with said shaft hole.

3. A rocker arm mechanism in an OHC type engine as claimed in claim 2, wherein said cam receiving portion further comprises a spherical portion at a side facing said cam and a flat portion at a top portion thereof.

* * * * *